US005332266A

United States Patent [19]

Canale

[11] Patent Number: 5,332,266

[45] Date of Patent: Jul. 26, 1994

[54] TELESCOPIC EXTENSION FOR A VACUUM CLEANER

[75] Inventor: Giuseppe Canale, Gorla Minore, Italy

[73] Assignee: OMEC S.p.A., Italy

[21] Appl. No.: 895,858

[22] Filed: Jun. 9, 1992

[30] Foreign Application Priority Data

Jun. 28, 1991 [IT] Italy ..... MI91 A 001775
Nov. 14, 1991 [IT] Italy ..... MI91 A 003035

[51] Int. Cl.[5] ..... F16L 35/00

[52] U.S. Cl. ..... 285/7; 285/24; 285/38; 285/303; 285/316; 285/320; 285/319; 285/921

[58] Field of Search ..... 285/7, 315, 316, 303, 285/24, 38, 320, 319, 921

[56] References Cited

U.S. PATENT DOCUMENTS

| | | | |
|---|---|---|---|
| 2,420,866 | 5/1947 | Coss | 285/174 |
| 2,438,750 | 3/1948 | Hughes | 285/170 |
| 3,244,437 | 4/1966 | Belicka et al. | 285/7 |
| 3,351,363 | 11/1967 | Downey et al. | 285/303 |
| 3,680,033 | 7/1972 | Kawal | 285/316 X |
| 5,031,266 | 7/1991 | Tillman et al. | 15/327.2 |
| 5,171,045 | 12/1992 | Pasbrig | 285/316 X |

FOREIGN PATENT DOCUMENTS

| | | | |
|---|---|---|---|
| 0293518 | 12/1988 | European Pat. Off. . | |
| 0399177 | 11/1990 | European Pat. Off. . | |
| 907006 | 3/1954 | Fed. Rep. of Germany . | |
| 2328567 | 1/1975 | Fed. Rep. of Germany | 285/316 |
| 3807028 | 9/1989 | Fed. Rep. of Germany . | |
| 3917351 | 11/1990 | Fed. Rep. of Germany . | |
| 1263595 | 5/1961 | France . | |

*Primary Examiner*—Dave W. Arola
*Attorney, Agent, or Firm*—Nixon & Vanderhye

[57] ABSTRACT

The invention relates a telescopic extension for a vacuum cleaner comprising an internal tube, an external tube, and a sleeve, wherein the internal tube is provided with a row of notches suitable for receiving a constraining element. According to an aspect of the invention said constraining element is provided with an appendix, preferably constituted by at least one small plate, with which an element of thrust is capable of coming into contact at least along a line running substantially in the direction of movement of said element of thrust, and advantageously over the entire surface of a portion of said small plate. According to an other aspect of the invention said sleeve comprises at least one first tubular casing and one second tubular casing fitted over said first tubular casing; said first tubular casing is provided with snap-on connecting means by means it is connected to the external wall of said external tube; said constraining element is movably supported by said first tubular casing and a manual operating means of said constraining element is slidingly supported by said first and second tubular casing.

29 Claims, 6 Drawing Sheets

TELESCOPIC EXTENSION FOR A VACUUM CLEANER

BACKGROUND

The present invention relates to a telescopic extension for an intake conduit of a vacuum cleaner, comprising an internal tube and an external tube sliding one inside the other, so that the length of the same extension can be adjusted telescopically and that the same tubes can be clamped in a relative selected positions to form a handle of desired length.

Generally in vacuum cleaners a suction mouth or a cleaning brush are connected to a vacuum cleaner by means of a conduit comprising a rigid section that facilitates its grasp, and a flexible section.

The rigid conduit section is formed by a telescopic extension comprising an internal tube and an external tube, sealingly sliding one inside the other, so as to convey air and dust in the flexible section and to constitute a handle that can be adjusted in length, suitable for maneuvering the suction mouth or the cleaning brush. Thus the extension should be capable of transmitting longitudinal forces of some magnitude.

The European patent application No. 0293518 describes a telescopic extension for a vacuum cleaner, comprising an internal tube and an external tube, sliding one inside the other, wherein a sleeve of suitable plastic material is mounted inside a flared section of the external tube, so that it fits over the internal tube. The internal tube is provided with a row of notches of a preselected shape, hemispherical or hemicylindrical, appropriately spaced, suitable for receiving a constraining element formed by a sphere or by a small cylindrical bar, supported by the sleeve itself.

In the sleeve there is also a means for manual operation, constituted by a ring nut or by a pushbutton which, normally, under the action of a spring, keeps an element of thrust in engagement with said constraining element and forces it into one of the notches of the internal tube, so as to lock the latter with respect to the external tube. By pressing said means for operation, against the action of the spring, the element of thrust is disengaged from the constraining element, which leaves the internal tube free to slide with respect to the external tube, allowing the length of the same extension to be adjusted.

In this telescopic extension, however, clearances appear in time which hinder the adjustment of its length, because in the element of thrust in plastic material impressions appear due to the fact that the contact with the constraining element made of steel takes place in an area substantially limited to a point or a line, and thus the specific pressure is very high. These impressions, which are formed in a direction substantially normal to the direction of movement of the element of thrust, tend to increase in time.

When the element of thrust is deformed, the constraining element remains loose in the notches of the internal tube, and is no longer capable of firmly locking the latter with respect to the external tube, in the desired position.

Another problems of said known telescopic extension arise from said flared section of the external tube, which needs complex operations for manufacturing.

The U.S. Pat. No. 3,351,363 describes a telescopic extension for vacuum cleaners, comprising an internal tube and an external tube, sealingly sliding one inside the other, wherein a sleeve in plastic material is mounted overhanging on the external wall of the external tube and is fastened to it by deformation of the same external tube inside an annular groove on it, or it is mounted inside a flared section of said external tube and is fastened by upsetting an edge of said external tube to act as a guide of the internal tube. The internal tube is provided with a row of hemispherical notches, appropriately spaced, suitable for receiving a constraining element formed by a ball that can be movably supported radially by the same sleeve.

In the sleeve there is also mounted a sliding or rotating manually-operated ring nut which, normally, under the action of a spring, thrusts said ball radially, through a element of thrust, into one of the notches of the internal tube, so as to lock the latter in the desired position with respect to the external tube. By moving the ring nut, against the action of the spring, the ball is disengaged and leaves the internal tube free to slide with respect to the external tube and allows the length of the extension itself to be adjusted.

One of the main disadvantages of this telescopic extension is represented by the fact that the connection between sleeve and external tube is accomplished by the latter's deformation through expansion instruments and through an upseting instrument. This operation, in addition to making the manufacturing cycle more complex and more expensive, can jeopardize the integrity of the tube, thus increasing the number of rejects.

Another disadvantage of the embodiment of the extension described having said sleeve overhanging, is represented by the fact that the sleeve constitutes a component that is too weak to effectively support the repeated stresses to which it is subjected during the operations for which the extension is destined.

Also in said latter telescopic extension impressions appear in the element of thrust in plastic material due to the fact that the contact with the element of constraining made of steel takes place in a very narrow area substantially limited to a point. Therefore in time clearance appears between the element of thrust and the element of constraining which remains loose in the notches of the internal tube, and is no longer capable of firmly locking the latter with respect to the external tube, in the desired position.

An object of the present invention is to provide a telescopic extension for vacuum cleaners in which the problems connected with the contact between the element of thrust and the constraining element are overcome, so as to to maintain maximum efficiency in time. Another object of the invention is to provide a telescopic extension that should be made and assembled in a manner that is easy and safe, without involving deformations of the external tube.

A further object of the present invention is to provide a telescopic extension that is strong, functional, reliable, and exempt from loose clearances even after prolonged use.

SUMMARY

According to a feature of the invention, it is provided a telescopic extension for a vacuum cleaner comprising an internal tube, an external tube, sealingly sliding one inside the other, a sleeve connected to said external tube, the internal tube being provided with a row of notches of a predetermined shape, appropriately spaced, a constraining element movably supported in said sleeve and a manual operating means subjected to the action of elastic means, capable of keeping an element of thrust in engagement with said constraining element, to force it into one of the notches of said internal tube and to lock the latter with respect to the external tube, and capable, against the action of said elastic means, of disengaging said element of thrust from said constraining element, leaving said internal tube free to slide inside the external tube, characterized in that said element of constraining is provided with an appendix with which said element of thrust is capable of coming into contact.

According to a preferred embodiment said appendix is formed by at least one small plate integral with said element of constraining, said element of thrust being capable of coming into contact with said small plate at least along a line running substantially in the direction of movement of said element of thrust.

According to another preferred embodiment at least one portion of said small plate is supported in said sleeve inclined at a selected angle with respect to the axis of said tubes, and said element of thrust is provided with a pressure wall inclined at the same angle with respect to the axis of the tubes, said pressure wall being capable of coming into contact with said portion of said small plate at least along a line running substantially in the direction of movement of the same element of thrust.

Preferably said pressure wall is capable of coming into contact with the entire surface of said portion of said small plate.

Advantageously said small plate is provided with a pivot by means of which it is supported in a suitable seat of said sleeve.

According to an other feature of the invention, it is provided a telescopic extension for a vacuum cleaner comprising an internal tube, an external tube, sealingly sliding one inside the other, a sleeve mounted on an external wall of said external tube, the internal tube being provided with a row of notches of a predetermined shape, appropriately spaced, a constraining element, and a manual operating means subjected to the action of elastic means, capable of keeping an element of thrust in engagement with said constraining element, to force it into one of the notches of said internal tube and to lock the latter with respect to the external tube, and capable, against the action of said elastic means, of disengaging said thrust means from said constraining element, leaving said internal tube free to slide inside the external tube, characterized in that said sleeve comprises at least one first tubular casing and one second tubular casing fitted over said first tubular casing, said first tubular casing being provided with snap-on connecting means with which it is connected to said external wall of the external tube, said constraining element being movably supported by said first tubular casing, said operating means being slidingly supported by said first and second tubular casing.

According to a preferred embodiment said snap-on connecting means are constituted by at least one partially-elastic tang, obtained in said first tubular casing and provided with at least one protrusion capable of engaging a corresponding opening of said external tube.

Preferably said first tubular casing is provided with a further tang, partially elastic, provided with a longitudinal projection suitable for engaging a corresponding longitudinal slot of said external tube and a corresponding longitudinal groove of said internal tube, so that relative sliding motions are allowed and relative rotations are prevented between said tubes.

Advantageously, said first tubular casing is provided with a projection suitable for engaging a centering port of said external tube. It is also provided with a seat capable of supporting said constraining element and is provided with guide recesses suitable for slidingly supporting a pushbutton constituting said operating means, said pushbutton being slidingly supported in a guide port of said second tubular casing.

With the solution according to this invention the element of thrust acts on the element of constraining and on the appendix constituted by the small plate, through a contact that is directed substantially in the direction of thrust, and that is preferably extended to a surface. There are thus avoided those deformations of the element of thrust which would jeopardize the engagement between the same element of thrust and the element of constraining.

With this invention a strong, functional, reliable telescopic extension is accomplished, having a sleeve firmly connected to the external tube by means of easily assembled connecting means.

The features and advantages of the invention shall now be described with reference to the drawings which, as non-limiting examples, represent preferred embodiments of this invention.

DETAILED DESCRIPTION OF THE DRAWINGS

Figure 1:
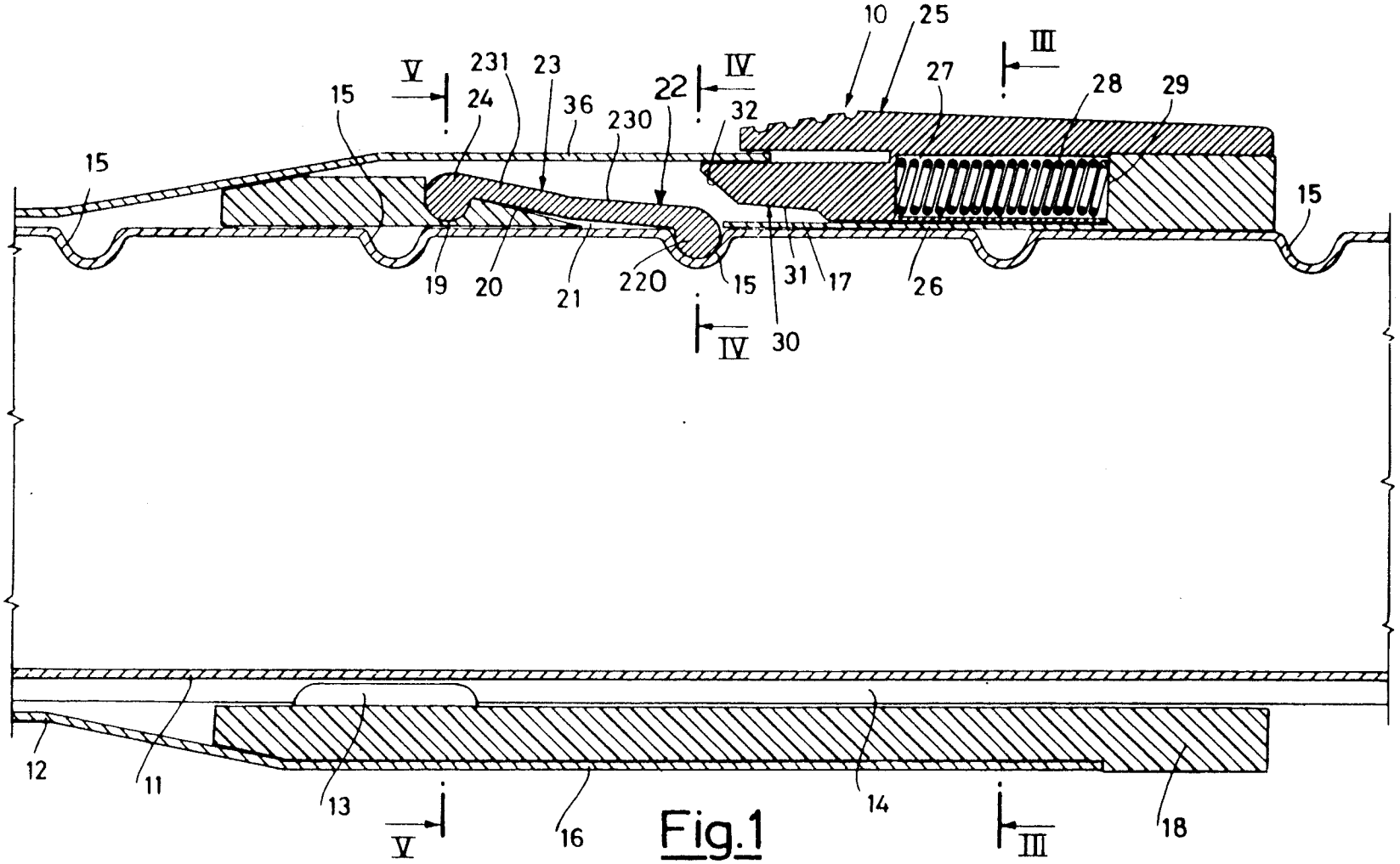
FIG. 1 shows a longitudinal sectional view of a first embodiment of a telescopic extension for a vacuum cleaner, accomplished according to the invention.

In the figures there is generally indicated by reference numeral 10 a telescopic extension for a vacuum cleaner constituted by an internal tube 11 and by an external tube 12, made of a steel sheet, sliding one inside the other, with the interposition of a usual sealing ring, not shown. The tube 11 is provided with a series of hemicylindrical notches 15 placed at a preset distance one from the other. The external tube 12 is provided with a flared section 16 in which there is a sleeve 18 of suitable plastic material, which is fastened by means of teeth, not show. The sleeve 18 is fitted over the internal tube 11 and is provided with a projection 13 which engages with a groove 14 of the internal tube 11, so that the latter can slide, but not rotate, with respect to the same sleeve. In the sleeve 18 there are a hemicylindrical recess 19, a ramp 20, an opening 21, and a recess 17 with a rectangular area connected with a recess 26 which also has a rectangular area.

There is indicated with reference numeral 22 a constraining element comprising a small bar 220 having a substantially cylindrical or other suitable shape, made of steel, suitable for introducing itself into the notches 15; with the small cylindrical bar 220 there is integral an appendix formed by a small plate generally indicated by reference numeral 23, which in turn is integral with the pivot 24. The small plate 23 is constituted by two portions 230 and 231, at an angle to one another of slightly less than 180°. The pivot 24 and the portion 231 of the small plate 23 are up against the recess 19 and the ramp 20, so that the portion 230 of the same plate is arranged at a given angle, in the specific case, 5°, with respect to the longitudinal axis of the tubes 11 and 12.

There is indicated by reference numeral 25 a pushbutton in a suitable plastic material slidably fitted in the rectangular recess 26 of the sleeve 18, to which it is constrained by means of tabs 34, which engage with the walls of an appropriate opening 35 obtained in a relief 36 of the section 16. The pushbutton 25 has a dead hole 27 in which a preloaded helical spring 28 is housed, which reacts with the wall 29 of the sleeve 18. The pushbutton 25 is provided with an element of thrust, indicated generally by reference numeral 30, provided with a thrust wall 31 and a mouth wall 32, bevelled. The thrust wall 31 is inclined at an angle with respect to the Longitudinal axis of the tubes 11 and 12 by the same angle selected for the portion 230 of the small plate 23, in this specific example 5°.

Under the action of the spring 28, the pushbutton 25 keeps the thrust wall 31 in contact with the entire surface of the portion 230 of the small plate 23, as shown in FIG. 1, and forces the small bar 220 into the notch 15 of the tube 11, which is below the opening 21 of the sleeve 18.

Figure 2:
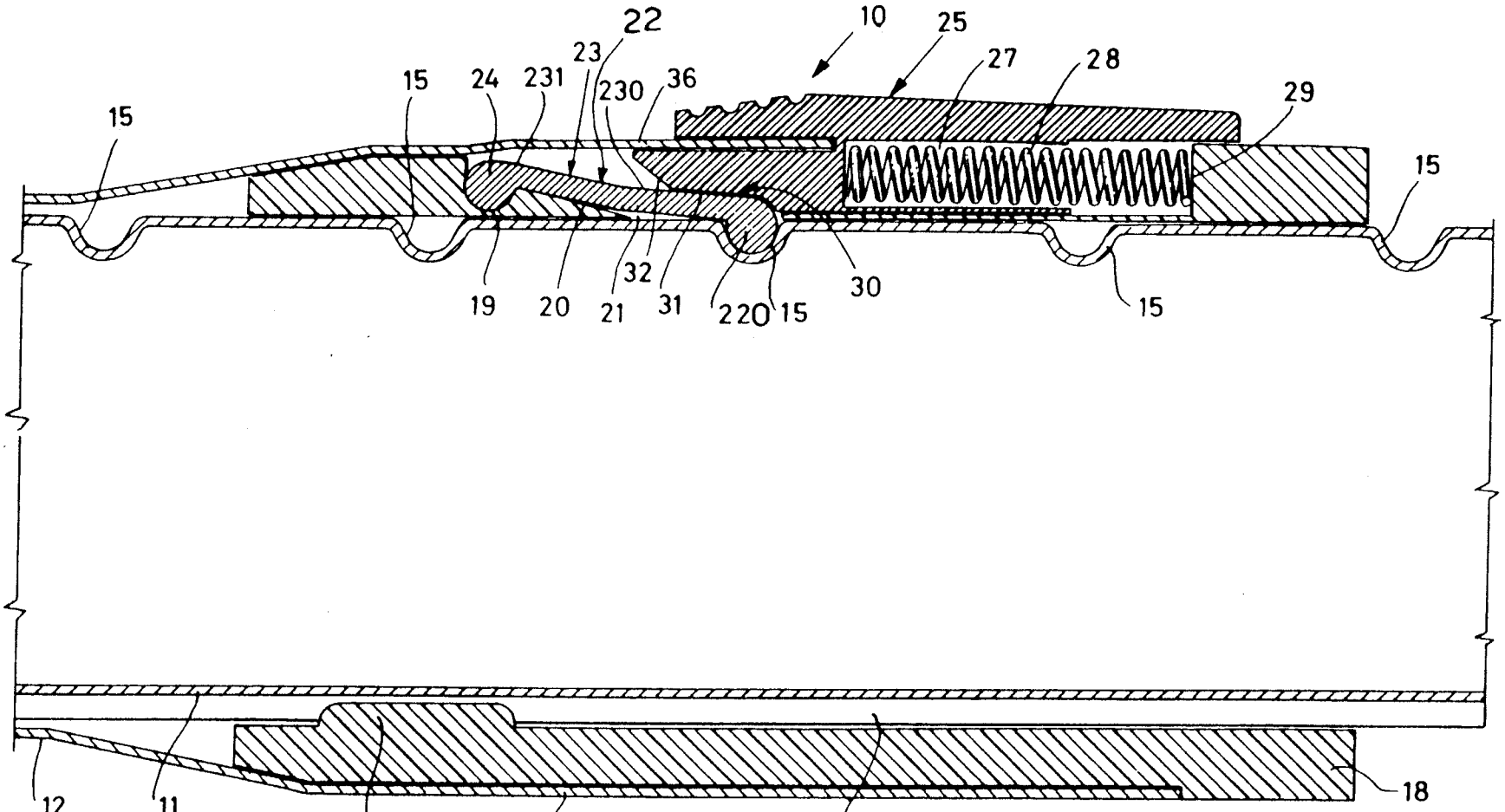
FIG. 2 shows the telescopic extension of FIG. 1 in a different operational condition.

To adjust the length of the telescopic extension 10, the pushbutton 25 is pulled from left to right, in the position represented in FIG. 1, so that the thrust wall 31 moves away from the portion 230 of the small plate 23 and allows the small bar 220 to leave the notch 15. This allows the tube 11 to be slide inside the tube 12 until the desired length is reached. When, under the action of the spring 28, the pushbutton 25 is released, the thrust wall 31 returns to being in contact with the portion 230 of the small plate 23, as shown in FIG. 2 and once again pushes the small bar 220 into another notch 15 of the tube 11, which has been brought opposite the opening 21, thus firmly locking the tubes 11 and 12 one with respect to the other and forming a very strong handle, suitable for operating the intake conduit of a vacuum cleaner.

The main advantage of the telescopic extension described is represented by the fact that the element of thrust 30 acts on the small bar 220 and on the appendix constituted by the small plate 23, through a contact that is directed substantially in the direction of thrust, and that preferably is extended to a surface. This allows the distribution of the applied thrust over a fairly large area and the reduction of the specific pressure between the parts in contact. There are thus eliminated the causes of deformation of the element of thrust and wear is also reduced considerably.

Another advantage of the proposed solution is represented by the mounting of the small plate 23 in the sleeve 18 at an angle with respect to the tubes 11 and 12. This arrangement, combined with the fact that any deformations would take place in the same direction of movement of the element of thrust, implies a self-locking effect, which ensures contact between the thrust wall 31 and the small plate 23, even if the same wall 31, in time, becomes worn or in the limit is deformed.

Figure 8:
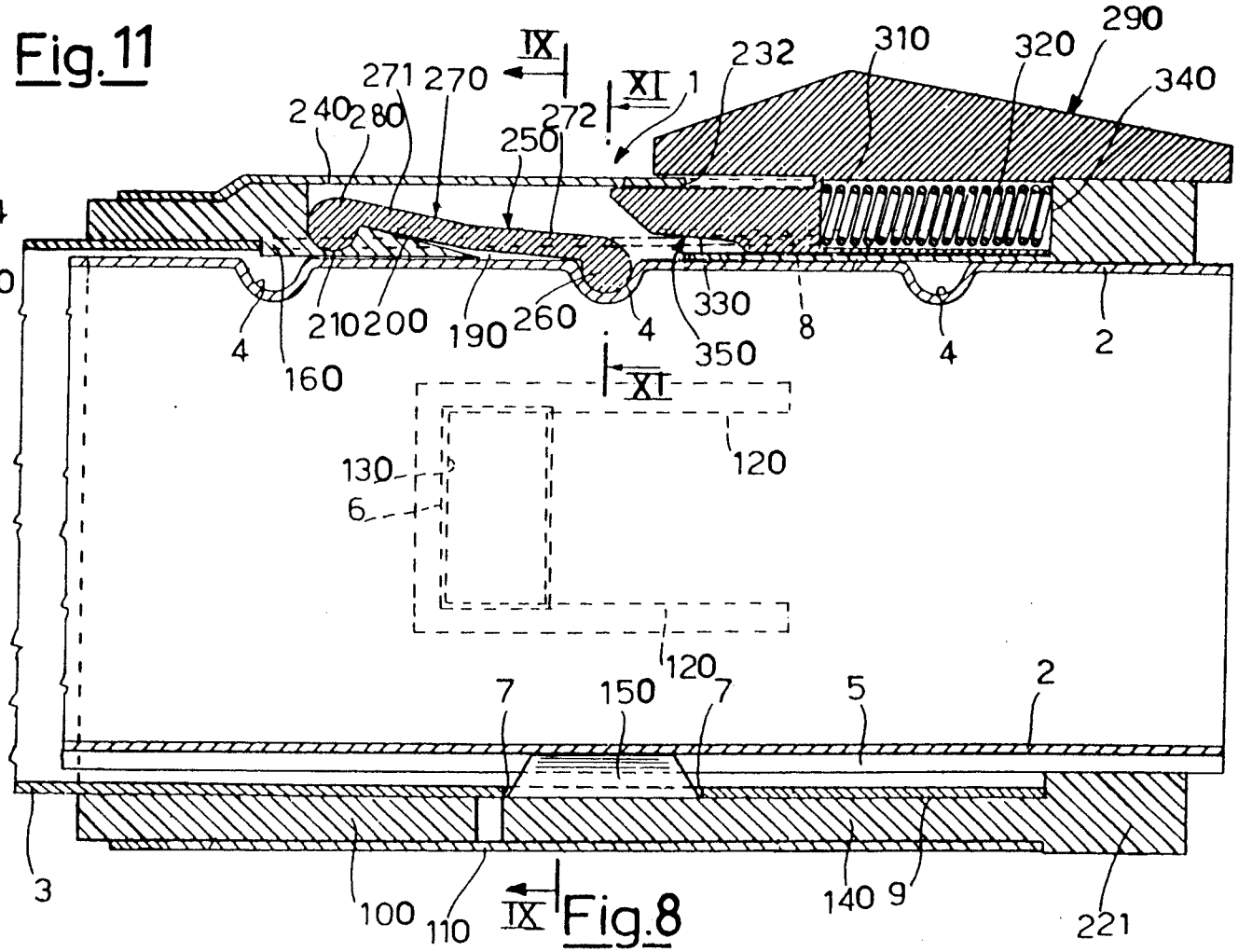
FIG. 8 shows a longitudinal cross-section of a second embodiment of a telescopic extension for vacuum cleaners according to the invention.
Figure 11:
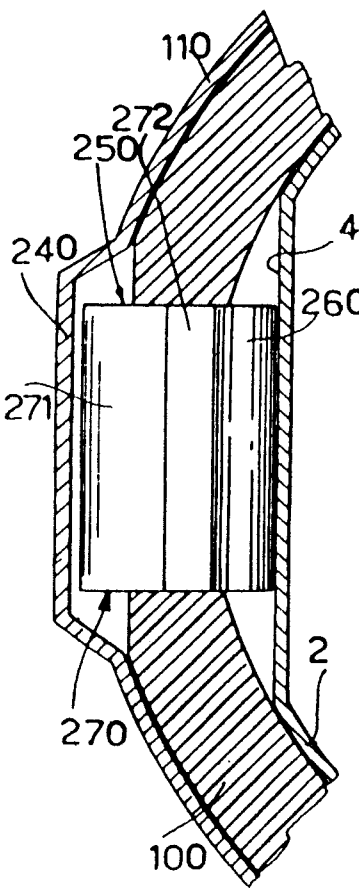
FIG. 11 is a partially sectioned enlarged view according to the plane indicated with XI—XI in FIG. 8.
Figure 9:
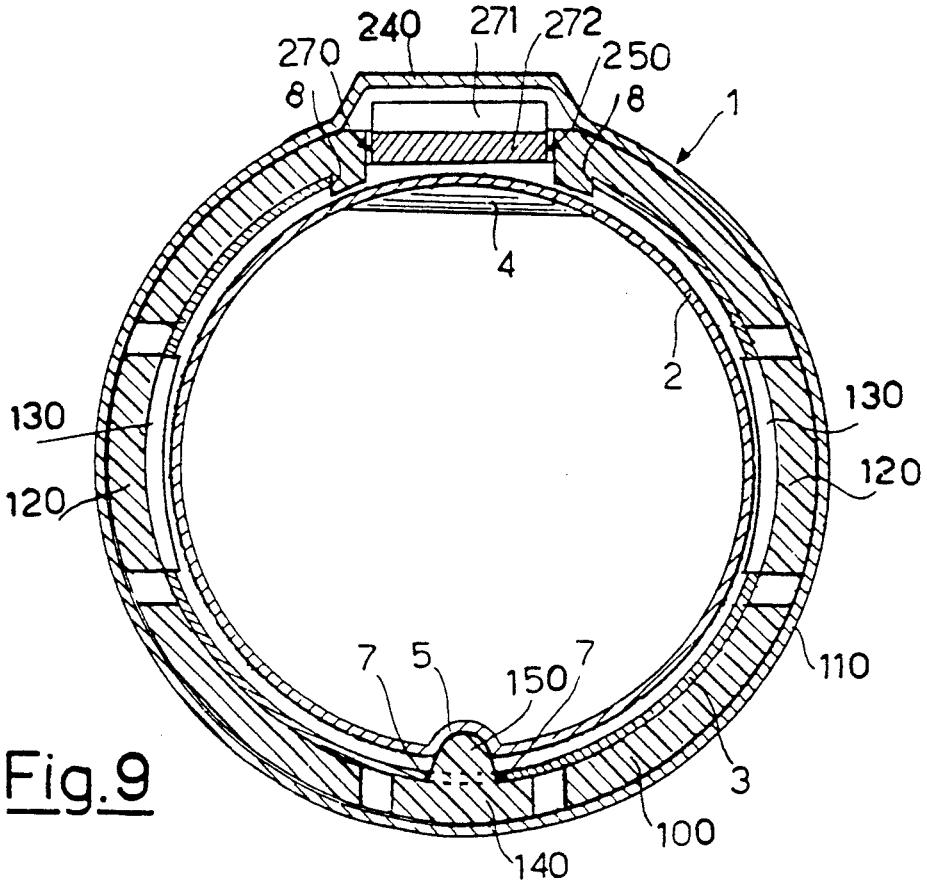
FIG. 9 is a cross-sectional view according to the plane indicated with IX—IX in FIG. 8.
Figure 10:
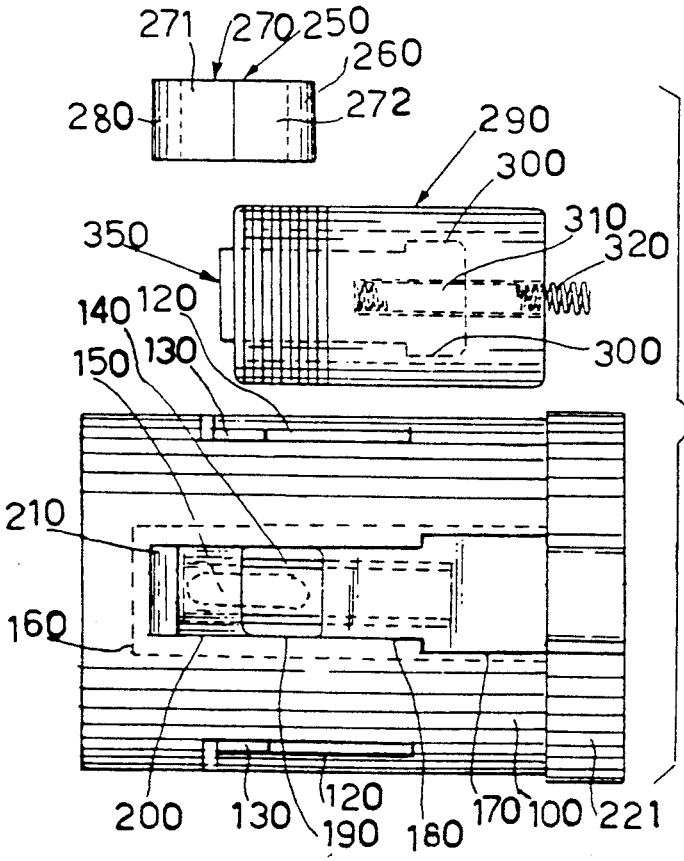
FIG. 10 is a plan view from above of a first tubular casing, of a pushbutton and of a constraining element of the telescopic extension of FIG. 8.

In FIGS. 8 and 9 there is generally indicated by reference 1 a sleeve for a telescopic extension for vacuum cleaners constituted by an internal tube 2 and by an external tube 3 in steel sheet chromium-plated externally, slidable one inside the other, with the interposition of a usual sealing ring, not shown. The tube 2 is provided with a series of semicylindrical notches 4 located at a predetermined distance one from the other and with a longitudinal groove 5. The external tube 3 is provided with two diametrically opposite openings 6, with a longitudinal slot 7 and with a port 8 that are also diametrically opposite to one another.

The sleeve 1 is formed by a first tubular casing 100 of suitable plastic material, and by a second tubular casing 110 in steel sheet chromium-plated externally, fitted with a slight interference over said first tubular casing 100.

The tubular casing 100 is fitted over the external wall 9 of the external tube 3 and is provided with snap-on connecting means constituted by two tangs 120, partially elastic, each provided with a protrusion 130 suitable for engaging a corresponding opening 6 of the external tube 3. The tubular casing 100 is also provided with a tang 140, partially elastic, provided with a longitudinal projection 150 suitable for engaging the slot 7 of the external tube 3 and the longitudinal groove 5 of the internal tube 2, so that the latter can slide, but not rotate, with respect to the external tube 3.

Figure 3:
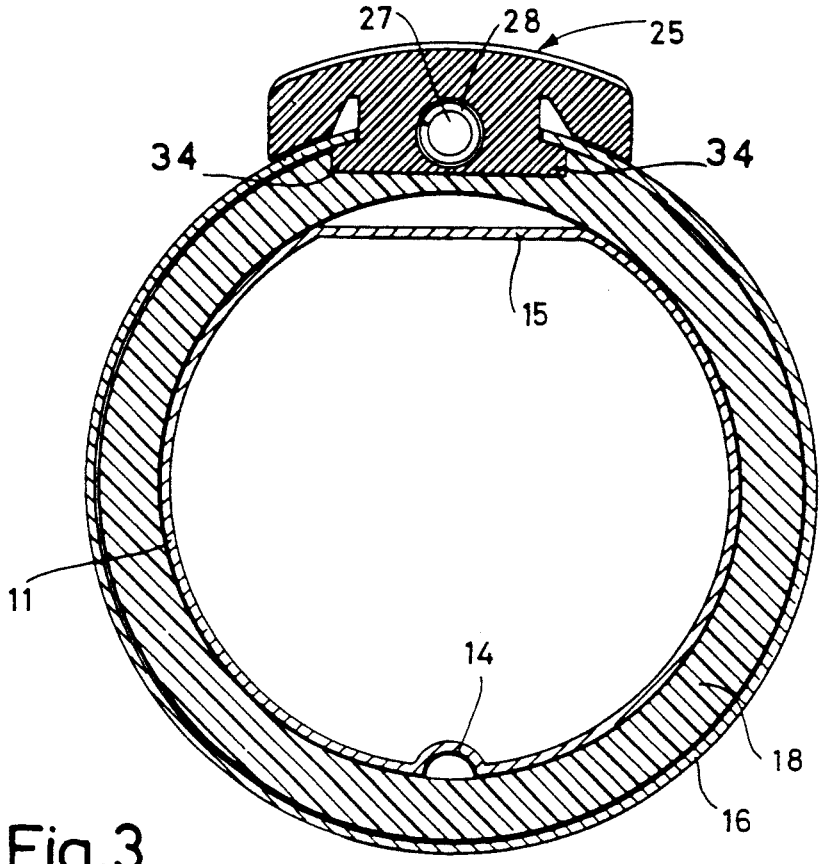
FIG. 3 is a sectional view taken along the plane III—III of FIG. 1.
Figure 5:
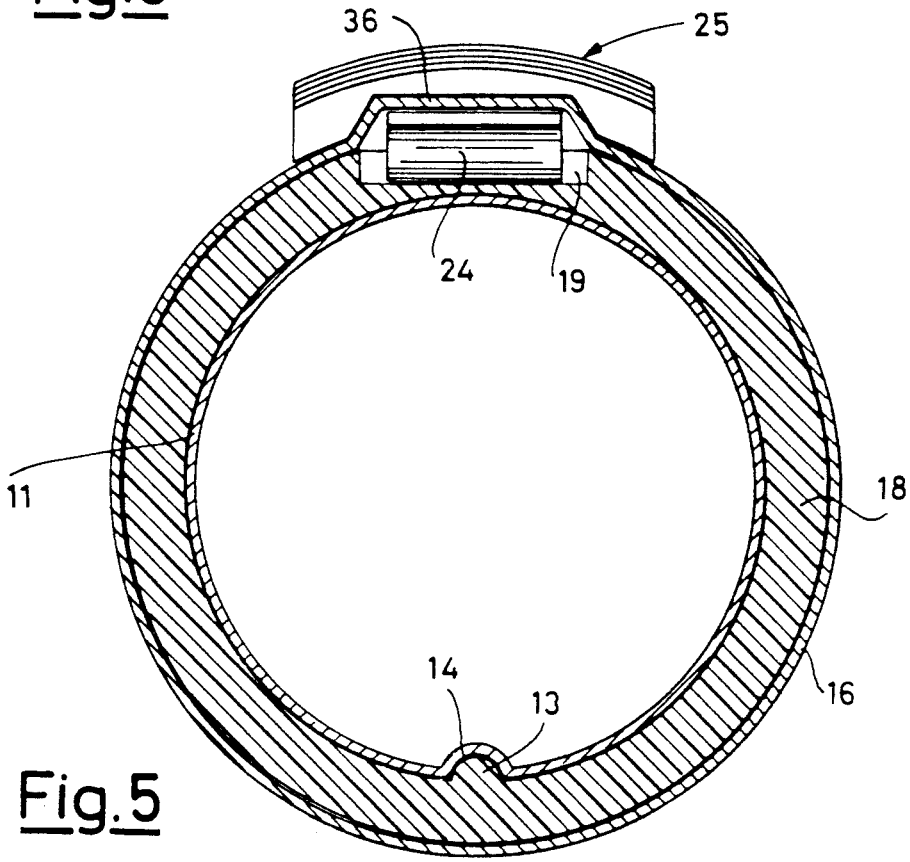
FIG. 5 is a sectional view taken along the plane V—V of FIG. 1.
Figure 4:
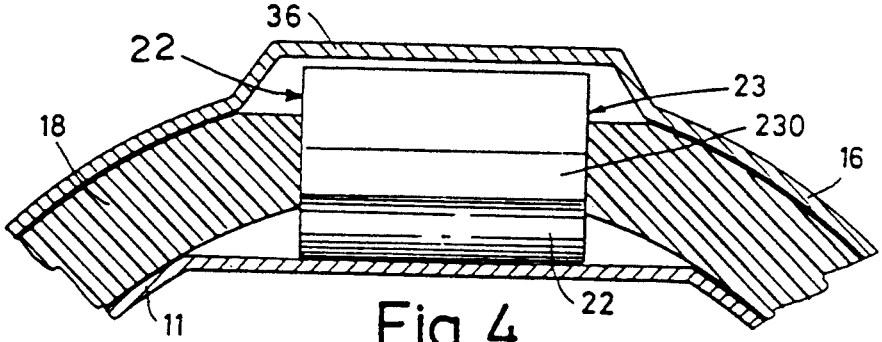
FIG. 4 is a partial sectional view taken along the plane IV—IV of FIG. 1.
Figure 6:
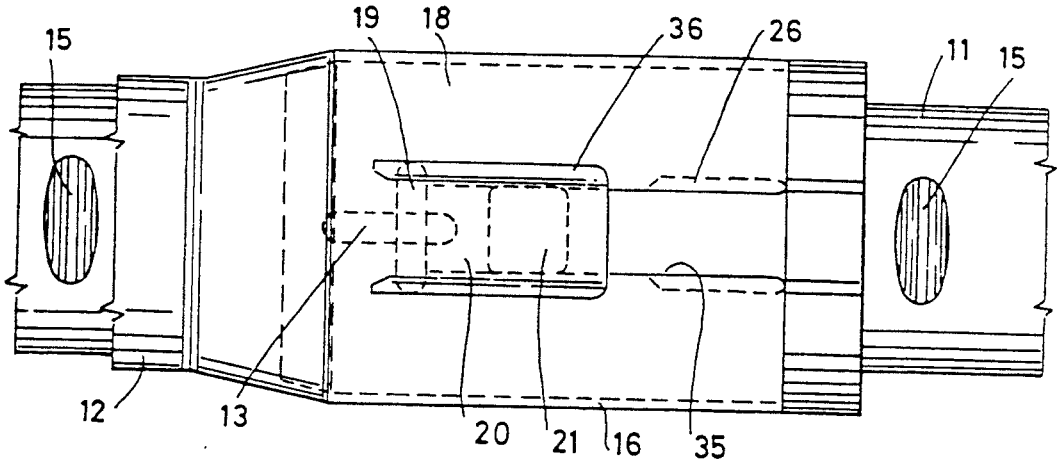
FIG. 6 is a top plan view of some components of the telescopic extension of FIG. 1.
Figure 7:
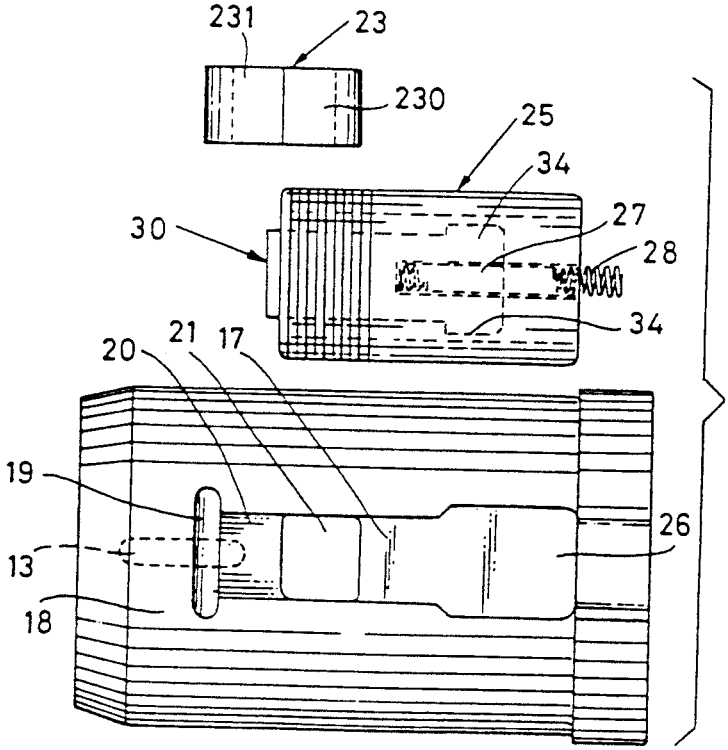
FIG. 7 is a top plan view of other components of the telescopic extension of FIG. 1.

There is indicated by reference numeral 160 a projection of the tubular casing 100 suitable for engaging a centering port 8 of the external tube 3. As is also shown in FIG. 3, in the projection 160 there are obtained a recess 170 with a rectangular area connected to a recess 180 also with a rectangular area, an opening 190, a ramp 200 and a semicylindrical recess 210. The tubular casing 100 is finally provided with an annular edge 221 which acts as an abutment to the external tube 3 and to the second tubular casing 110 and that is fitted over the internal tube 2.

The second tubular casing 110 is provided with a port 232 and with a relief 240 located opposite the projection 160 of the first tubular casing 100.

There is generally indicated by reference numeral 250 a constraining element, also visible in FIG. 3, comprising a small partially cylindrical bar 260, in steel, preferably in hardened stainless steel, suitable for being inserted in the notches 4 of the internal tube 2. The constraining element 250 can be constituted by a ball or by a roller, but preferably it is made by a small cylindrical bar 260 which is integral with an appendix formed by a small plate indicated as a whole with 270, which in turn is integral with a pin 280. The small plate 270 is constituted by two portions 272 and 271, inclined at an angle to one another of slightly less than 180°. The pin 280 and the portion 271 of the small plate 270 rest up against the recess 210 and the ramp 200, so that the portion 272 of said small plate is inclined at a given angle, in the illustrated example 5°, with respect to the longitudinal axis of the tubes 2 and 3.

There is generally indicated by reference 290 a pushbutton in suitable plastic material, also visible in FIG. 3, slidingly mounted in the rectangular recesses 170 and 180 of the tubular casing 100 and engaged by means of tongues 300 with the guide port 232 of the tubular casing 110. The pushbutton 290 is provided with a blind hole 310 in which there is housed a pre-loaded helical spring 320, reacting against the wall 340 of the tubular casing 100. The pushbutton 280 is provided with an element of thrust, generally indicated by reference numeral 350, provided with a thrust wall 330 inclined at an angle with respect to the longitudinal axis of the tubes 2 and 3 that is the same as the one selected for the portion 272 of the small plate 270, in the specific case 5°.

The pushbutton 290, under the action of the spring 320, keeps the thrust wall 330 in contact with the entire surface of the portion 272 of the small plate 270, forcing the small bar 260 inside the slot 4 of the tube 2, that is under the opening 190 of the tubular casing 100.

To adjust the length of the extension, the sleeve 1 is grasped and the pushbutton 290 is pulled from left to right, in the position represented in FIG. 8, so that the thrust wall 330 moves away from the portion 272 of the small plate 270 and releases the small bar 260 to exit from the notch 4. This allows the tube 2 to slide inside the tube 3 until the desired length is reached.

When the pushbutton 290 is released, under the action of the spring 320, the thrust wall 330 returns in contact with the portion 272 of the small plate 270 and again pushes the small bar 260 inside the notch 4 of the tube 2 that has been brought opposite the opening 190, so that the tubes 2 and 3 are safely locked one with respect to the other.

For mounting the sleeve 1 proceed by mounting the tubular casing 100 on the wall 9 of the external tube 3 and by firmly fastening it to said wall 9 by means of the protrusions 130 of the tangs 120 and the projection 150 of the tang 140, and by means of the tubular casing 110, that is fitted with a slight interference over said first tubular casing 100. A handle is thus formed with a very strong grip, suitable for maneuvering the suction conduit of vacuum cleaners.

The advantages of the described sleeve 1 are represented by its strength, efficiency, reliability, and by the simplicity of assembly, due to the presence of the two tubular casings 100 and 110 and of the tangs 120, 140 with respective protrusions 130 and projection 150.

I claim:

1. A telescopic handle extension for a vacuum cleaner comprising:

an external tube having a longitudinal axis;

an internal tube situated in selective sliding relation to the external tube, an exterior surface of the internal tube having a plurality of notches provided thereon, the notches being spaced apart in a direction parallel to the longitudinal axis;

a sleeve at least partially retained between the external tube and the internal tube;

a constraining element, the constraining element including:

a distal end configured to mate with the notches provided on the internal tube;

a proximal end which is pivotally engaged by the sleeve; and a plate intermediate the distal and proximal ends of the constraining element; and a manually operated actuator element, the actuator element having a thrust wall which is resiliently biased against at least a portion of a surface of the plate of the constraining element to force the distal end of the constraining element into a desired one of the plurality of notches and thereby prevent movement of the constraining element along the longitudinal axis, wherein the application of force to the actuator element in a direction parallel to the longitudinal axis to overcome the resilient biasing causes the actuator element to disengage the constraining element whereby the distal end of the constraining element is free to exit the one of the plurality of notches with which it has been mated, and thereby permitting the application of force to the internal tube to cause the internal tube to slide along the longitudinal axis for facilitating alignment of the distal end of the constraining element with a selected one of the plurality of notches.

2. A telescopic extension according to claim 1, wherein when the distal end of the constraining element is free to exit the one of the plurality of notches with which it has been mated, the internal tube is free to slide inside the external tube.

3. A telescopic extension according to claim 1, wherein the thrust wall of the actuator element and the portion of the plate against which the thrust wall is biased are inclined at a same angle of inclination with respect to the longitudinal axis.

4. A telescopic extension according to claim 3, wherein the angle of inclination is 5 degrees.

5. A telescopic extension according to claim 1, wherein an entire surface of the portion of the plate against which the thrust wall is biased is contacted by the thrust wall when the actuator element is biased against the constraining element.

6. A telescopic extension according to claim 1, wherein the proximal end of the constraining element is pivotally received in a seat formed in the sleeve.

7. A telescopic extension according to claim 1, wherein the distal end of the constraining element comprises a cylindrical bar, wherein the plate of the constraining element is integral with the distal and proximal ends thereof, wherein an entire surface of the portion of the plate against which the thrust wall is biased is contacted by the thrust wall when the actuator element is biased against the constraining element, and wherein the thrust wall of the actuator element and the portion of the plate against which the thrust wall is biased are inclined at a same angle of inclination with respect to the longitudinal axis.

8. A telescopic extension according to claim 1, wherein the sleeve comprises:

at least one first tubular casing;

at least one second tubular casing, the second tubular casing fitted over the first tubular casing; and means for connecting the first tubular casing to an external wall of the external tube.

9. A telescopic extension according to claim 8, wherein the manually operated actuator element is supported by at least one of the first tubular casing and the second tubular casing.

10. A telescopic extension according to claim 9, characterized in that said first tubular casing is provided with a seat suitable for supporting said proximal end of said constraining element and is provided with guide recesses suitable for supporting a pushbutton comprising said actuator element, said pushbutton being slidingly supported in a guide port of said second tubular casing.

11. A telescopic extension according to claim 10, characterized in that said constraining element comprises a partially cylindrical bar integral with a plate which in turn is integral with a pin, at least one portion of said plate being supported in a ramp of said seat of said first tubular casing, said ramp being inclined at a given angle with respect to the longitudinal axis of the tubes, said pin being supported in a semicylindrical recess of said first tubular casing, said actuator element being provided with a thrust wall inclined at the same angle with respect to said axis of the tubes, said thrust wall being capable of coming into contact, under the action of said resilient biasing, with the plate.

12. A telescopic extension according to claim 8, wherein the connecting means comprises snap-on connecting means by which the first tubular casing is connected to the external wall of the external tube.

13. A telescopic extension according to claim 12, characterised in that said snap-on connecting means are constituted by at least one partially-elastic tang, obtained in said first tubular casing and provided with at least one protrusion suitable for engaging a corresponding opening of said external tube.

14. A telescopic extension according to claim 12, characterised in that said first tubular casing is provided with a further tang, partially elastic, provided with a longitudinal projection suitable for engaging a corresponding longitudinal slot of said external tube and a corresponding longitudinal groove of said internal tube, so that relative sliding motions are allowed and relative rotations are prevented between said tubes.

15. A telescopic extension according to claim 12, characterised in that said second tubular casing is fitted with a slight interference over said first tubular casing.

16. A telescopic extension according to claim 12, characterised in that said first tubular casing is provided with a projection suitable for engaging a centering port of said external tube.

17. A telescopic handle extension for a vacuum cleaner comprising:

an external tube having a longitudinal axis and an external wall;

an internal tube situated in selective sliding relation to the external tube, an exterior surface of the internal tube having a plurality of notches provided thereon, the notches being spaced apart in a direction parallel to the longitudinal axis;

a sleeve mounted on the external wall of the external tube, the sleeve comprising:

at least one first tubular casing;

at least one second tubular casing, the second tubular casing fitted over the first tubular casing; and means for connecting the first tubular casing to an external wall of the external tube;

a constraining element configured to mate with the notches provided on the internal tube; and a manually operated actuator element, the actuator element being resiliently biased against the constraining element to force the constraining element into a desired one of the plurality of notches and thereby prevent movement of the constraining element along the longitudinal axis, wherein the application of force to the actuator element in a direction parallel to the longitudinal axis to overcome the resilient biasing causes the actuator element to disengage the constraining element whereby the constraining element is free to exit the one of the plurality of notches with which it has been mated, so that the internal tube is free to slide inside the external tube for facilitating alignment of the constraining element with a selected one of the plurality of notches.

18. A telescopic extension according to claim 17, wherein the constraining element is supported by the first tubular casing; and wherein the manually operated actuator element is supported by at least one of the first tubular casing and the second tubular casing.

19. A telescopic extension according to claim 17, wherein the connecting means comprises snap-on connecting means by which the first tubular casing is connected to the external wall of the external tube.

20. A telescopic extension according to claim 19, wherein said snap-on connecting means comprise at least one partially-elastic tang, obtained in said first tubular casing and provided with at least one protrusion suitable for engaging a corresponding opening of said external tube.

21. A telescopic extension according to claim 19, wherein said first tubular casing is provided with a further tang, partially elastic, provided with a longitudinal projection suitable for engaging a corresponding longitudinal slot of said external tube and a corresponding longitudinal groove of said internal tube, so that relative sliding motions are allowed and relative rotations are prevented between said tubes.

22. A telescopic extension according to claim 17, wherein said second tubular casing is fitted with a slight interference over said first tubular casing.

23. A telescopic extension according to claim 17, wherein said first tubular casing is provided with a projection suitable for engaging a centering port of said external tube.

24. A telescopic extension according to claim 17, wherein said constraining element includes:

a distal end configured to mate with the notches provided on the internal tube;

a proximal end; and a plate intermediate the distal and proximal ends of the constraining element; and wherein said first tubular casing is provided with a seat suitable for pivotally supporting said proximal end of said constraining element and is provided with guide recesses suitable for supporting a pushbutton comprising said actuator element, said pushbutton being slidingly supported in a guide port of said second tubular casing.

25. A telescopic extension according to claim 24, wherein said constraining element comprises a partially cylindrical bar integral with a plate which in turn is integral with a pin, at least one portion of said plate being supported in a ramp of said seat of said first tubular casing, said ramp being inclined at a given angle with respect to the longitudinal axis of the tubes, said pin being supported in a semicylindrical recess of said first tubular casing, said actuator element being provided with a thrust wall inclined at the same angle with respect to said axis of the tubes, said thrust wall being capable of coming into contact, under the action of said resilient biasing, with the plate.

26. A telescopic extension according to claim 24, wherein the thrust wall of the actuator element and the portion of the plate against which the thrust wall is biased are inclined at a same angle of inclination with respect to the longitudinal axis.

27. A telescopic extension according to claim 24, wherein the proximal end of the constraining element is pivotally received in a seat formed in the first tubular casing of the sleeve.

28. A telescopic extension according to claim 24, wherein the distal end of the constraining element comprises a cylindrical bar, wherein the plate of the constraining element is integral with the distal and proximal ends thereof, wherein an entire surface of the portion of the plate against which the thrust wall is biased is contacted by the thrust wall when the actuator element is biased against the constraining element, and wherein the thrust wall of the actuator element and the portion of the plate against which the thrust wall is biased are inclined at a same angle of inclination with respect to the longitudinal axis.

29. A telescopic extension according to claim 28, wherein the angle of inclination is 5 degrees.

* * * * *